US006450160B1

(12) United States Patent
Fu et al.

(10) Patent No.: US 6,450,160 B1
(45) Date of Patent: Sep. 17, 2002

(54) CONFETTI DISPERSION DEVICE

(75) Inventors: Jlang Ze Fu; Nie Ye Ji, both of Zibo (CN)

(73) Assignee: Winco Fireworks International, L.L.C., Prairie Village, KS (US)

( * ) Notice: Subject to any disclaimer, the term of this patent is extended or adjusted under 35 U.S.C. 154(b) by 0 days.

(21) Appl. No.: 09/750,942

(22) Filed: Dec. 28, 2000

(51) Int. Cl.[7] ..... F41B 11/08

(52) U.S. Cl. ..... 124/57; 124/70; 124/71; 124/72; 124/73; 124/74; 124/75; 124/76; 124/77; 124/58; 124/63

(58) Field of Search ..... 124/57, 58, 63, 124/70–77; 446/181, 429, 473, 475; 221/22; 42/54, 57, 58, 55; 463/2, 49, 50, 64

(56) References Cited

U.S. PATENT DOCUMENTS 54,783 A * 5/1866 Scotton ..... 124/71
2,264,586 A * 12/1941 Ross ..... 604/15
2,756,737 A * 7/1956 Resch, Jr. ..... 124/62
4,216,609 A * 8/1980 Ortiz ..... 446/401
5,015,211 A * 5/1991 Reveen ..... 124/74
5,117,995 A * 6/1992 Kau ..... 116/281
5,149,290 A * 9/1992 Reveen ..... 124/74
5,529,527 A * 6/1996 Watkins ..... 124/60
5,634,840 A * 6/1997 Watkins ..... 446/475
5,772,491 A * 6/1998 Watkins ..... 446/475
6,158,588 A * 12/2000 Conti ..... 116/307

* cited by examiner

*Primary Examiner*—Charles T. Jordan
*Assistant Examiner*—Stephen A Holzen
(74) *Attorney, Agent, or Firm*—John C. McMahon

(57) ABSTRACT

A confetti discharge device includes a tube with an air cylinder located in one end of the tube and confetti packed in the tube between the cylinder and a discharge end of the tube. A release mechanism includes a stopper located in a mouth of the cylinder and a keeper. The keeper is held in place by a latch that is manually releaseable by a user to allow the stopper to come out of the mouth of the cylinder due to air pressure so that the air in the cylinder discharges the confetti from the tube.

4 Claims, 1 Drawing Sheet

Fig. 1.
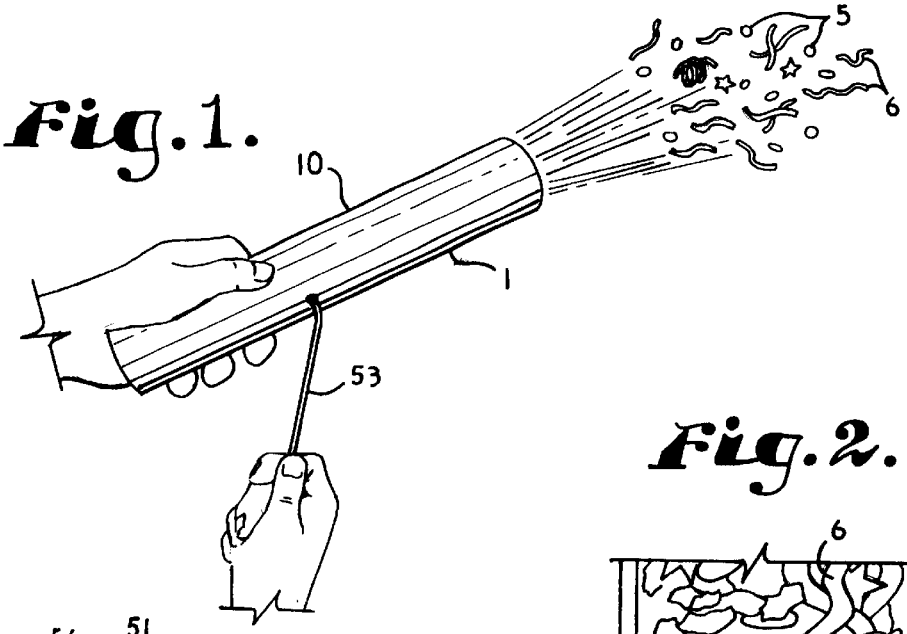
Fig. 2.
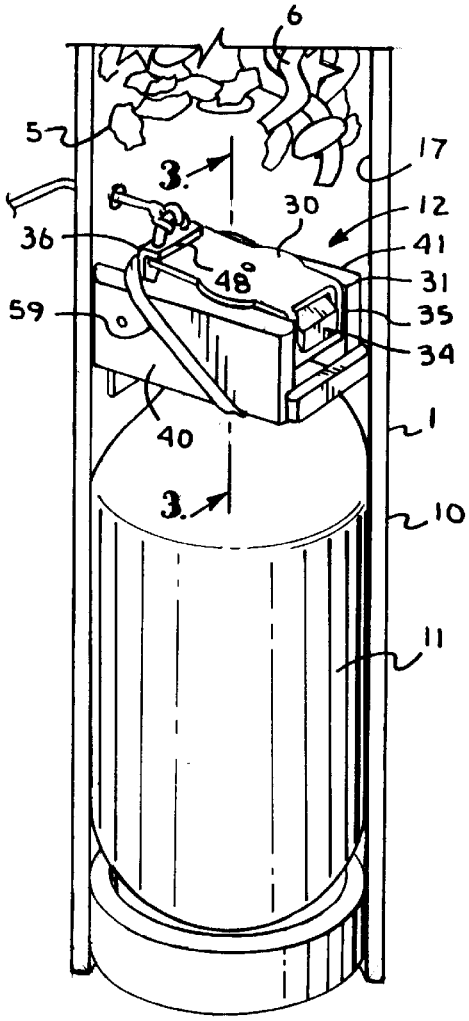
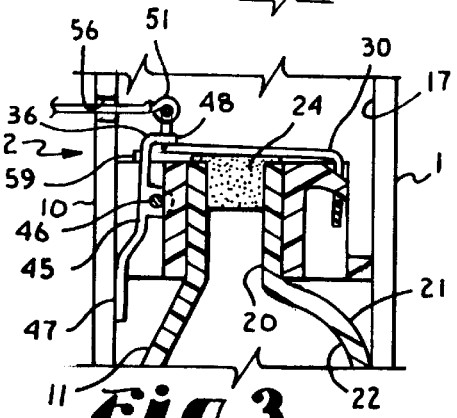
Fig. 3.
Fig. 4.
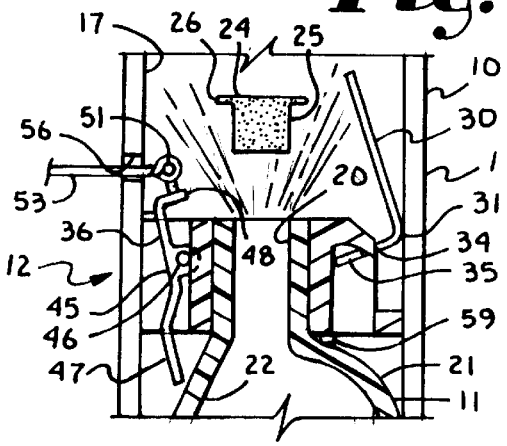

CONFETTI DISPERSION DEVICE

BACKGROUND OF THE INVENTION

The present application is directed to a device for dispersing lightweight confetti, streamers and the like utilizing compressed air.

Airborne confetti and streamers are quite popular at various types of celebrations or similar events such as football games, parades, weddings, New Years Eve parties, political conventions and like occasions. In the past persons at such occasions have thrown handfuls of confetti or rolls of streamers which are limited by the volume that can be thrown and dispersed at a single time. Explosive devices, which have a cannon-type barrel and some type of explosive compound such as gun powder, have been used in the past to discharge large quantities of confetti and the like. However, explosive devices are inherently dangerous in that someone can be seriously injured by the explosion, if it goes astray. Furthermore, such devices are either normally very small and can handle relatively little confetti so as to provide some protection to the user against injury from the explosion or alternatively are larger and must be handled by someone who has expertise in the handling of such devices. Therefore, the use of explosive devices that can discharge large amounts of confetti are not available to the public and are relatively quite limited in their use. Any device using gunpowder is highly regulated.

Consequently, it is desirable to provide a device that is capable of discharging relatively large amounts of confetti, streamers and the like into the air with a single discharge such that the discharged material covers a relatively large area and that can be utilized by almost any adult with relatively little training.

SUMMARY OF THE INVENTION

A dispersion device is provided for discharging pieces of confetti, streamers or the like that are made from lightweight materials such as paper, thin flexible plastic and other suitable materials that can be dispersed into the air and thereafter float to the ground without injuring people that such may strike. The device includes a tube that has a discharge end and which is partially filled with confetti and/or streamers. The end of the tube opposite the discharge end includes a compressed air cylinder and a release mechanism for releasing the compressed air in the cylinder into the tube behind the confetti, so as to discharge the confetti from the tube in a shower.

In particular, the cylinder has a mouth with a plug that keeps air from seeping from the mouth. The plug is held in place by a keeper that extends across the top of the plug and which is hinged or pivoted on one end to allow the keeper to rotate upwardly when the keeper is released to thereafter release the plug. The keeper is held in place by a latch mechanism. Preferably, the latch mechanism includes an arm pivotally attached to the cylinder that has a flange that extends over the keeper when in a ready position or non discharged configuration. The latch can then be manually moved by a cord or the like away from the keeper so as to release the keeper and consequently the plug and air contents of the cylinder. This in turn blows the confetti and streamers out the discharge end of the tube.

OBJECTS AND ADVANTAGES OF THE INVENTION

Therefore, the objects of the present invention are: to provide a confetti dispersion device that discharges a large quantity of airborne material such as paper confetti, streamers or the like into the air in a single discharge; to provide such a device that does not use a gunpowder explosive charge for discharge of the material into the air; to provide such a device utilizing compressed air for discharging the confetti into the air; to provide such a device wherein compressed air is provided by a small cylinder and is maintained in the cylinder by a plug that is further maintained in place by a keeper that is released by a user when discharge is desirable; to provide such a device that is easy to use and can be utilized by individuals at celebrations and the like without extensive training; and to provide such a device that is inexpensive to produce, easy to utilize and especially well adapted for the intended purposes thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a confetti dispersion device in accordance with the present invention in a discharge configuration wherein confetti and streamers are being discharged from one end of the device.

FIG. 2 is a fragmentary and cross-sectional view of the interior of the device showing a compressed air cylinder and a release mechanism for releasing compressed air from the cylinder with confetti in the tube and it is noted that the confetti is shown spaced away from the release mechanism solely for the purpose of allowing better view of the release mechanism, as in normal use the confetti would abut against the release mechanism.

FIG. 3 is a fragmentary and cross-sectional view of the interior of the tube, compressed air cylinder and release mechanism, taken along line 3—3 of FIG. 2.

FIG. 4 is a fragmentary and cross-sectional view of the device showing the compressed air cylinder and release mechanism in a discharge configuration at the time of release of compressed air from the cylinder.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates a device for distribution of confetti. As used herein the term confetti refers to small pieces of paper 5 and streamers 6 that may be used interchangeably or together in the device 1 or similar material. Other devices that are light and suitable for airborne dispersion such as thin colored plastic ribbons and pieces may also be used within the scope of the invention as confetti within the device 1.

The device 1 includes a tube 10 a compressed air cylinder 11 and a release mechanism 12.

The tube 10 is elongate and has a discharge end 16 and an interior cylindrical chamber 17. The compressed air cylinder 11 is positioned in the bottom of the tube 10 opposite the discharge end 16. Confetti pieces 5 and streamers 6 are packed in the tube 10 generally between the compressed air cylinder 11 and the discharge end 16. As seen in the FIGS. 2–4, the confetti pieces 5 and streamers 6 are shown as located away from the release mechanism 12 for purposes of illustration only. In normal use, the confetti pieces 5 and streamers 6 would be packed around the release mechanism 12 and compressed air cylinder 11. This spacing is done solely to illustrate the release mechanism 12 and cylinder 11 better. The entire tube would normally be wrapped in a foil or clear plastic wrap (not shown) that is removed prior to use. The tube discharge end 16 may also have a think foil cover or the like to keep the confetti in the tube 10 prior to intentional discharge.

The compressed air cylinder 11 is elongate and sized to snugly fit into the lower end of the chamber 17. Normally, it is constructed of a lightweight material such as plastic with sufficient strength to maintain the pressurized air at the level of pressurization desired for the particular device 1.

In particular, the discharge pressure of the air within the cylinder 11 can be varied depending on the length of the tube 10 and amount of pieces 5 and/or streamers 6 to be discharged therefrom. Furthermore the pressure can be modified to deliver the pieces 5 and streamers 6 further into the air or over a wide discharge path, if so desired, by increasing the pressure or alternatively the confetti can be sent only a short distance by decreasing the air pressure. Consequently, the air pressure within the cylinder 11 is dependent upon the amount of confetti material and distance desired for discharge of the material and each particular product requires testing to determine the optimum pressure desired.

The compressed air cylinder 11 has an upper mouth 20 that opens into the chamber 17 and faces the tube discharge end 16. The mouth 20 is circular in shape and preferably has a smaller cross-section than a body 21 of the cylinder 11. The cylinder 11 has an internal air holding cavity 22 that flows into the mouth 20.

In a ready mode or non-discharge configuration, the cylinder mouth 20 is occluded by a plug or stopper 24. The stopper 24 has a body 25 and a cap 26 with the body 25 snugly fitting within the mouth 20 and the cap 26 extending slightly outward over the side of the mouth 20. The stopper 24 is constructed of a rubber or similar substance that prevents flow of the compressed air through the mouth 20 when the stopper 24 is positioned within the mouth 20.

As is shown in FIG. 3, the stopper 24 is held within the mouth by a keeper 30. A pivot end 31 of the keeper 30 is pivotally connected to the compressed air cylinder 11 by a hook 34 that captures a ring 35 on the keeper 30. The keeper 30 is held in place, as seen in FIGS. 2 and 3 by a latch 36. The keeper 30 is relatively thin and elongate. When the latch 36 releases the keeper 30, the keeper 30 is free to swing about the pivot end 31 thereof and allow release of the stopper 24 from the compressed air cylinder mouth 20 as is illustrated in FIG. 4.

When the stopper 24 is released from the cylinder 11, the compressed air within the cylinder body 21 is released into the tube chamber 17 behind the confetti pieces 5 and streamers 6 and subsequently drives or forces the pieces 5 and streamers 6 from the discharge end 16 of the tube 10. The keeper 30 is specifically secured to a ring 38 that is attached to the exterior of the compressed air cylinder 11 in the region of the mouth 20. The ring 38 has a pair of spaced walls 40 and 41 attached thereto and the hook 34 that joins with the pivot end 31 of the keeper 30 for maintaining the keeper 30 within the tube 10 after release of the stopper 24.

The latch 36 has a central arm 45 that is pivotally attached to the ring 38 by a pivot pin 46 opposite the hook 43. The latch 36 has a tail 47 that abuts against the chamber 17 when the latch 36 is in a ready position or non-discharge configuration, such as is shown in FIG. 3. The latch 38 also has an upper hand or flange 48 that extends over the keeper 30 when in the ready position. The flange 48 holds the keeper 30 in covering position over the stopper 24 and thus prevent the release of the stopper 24 until the flange 48 is removed from covering position over the keeper 30, as is seen in FIG. 4 wherein the latch 36 is in a release configuration thereof.

The latch 36 has an upper attachment eye 51 to which a pull string 53 is secured. The pull string 53 extends through an aperture 56 in the tube 10 partway between the top and bottom thereof. The pull string 53 is graspable by the hand of the user to allow the user to pull the pull string 53 radially outward and thereby swing the latch 36 from the latching or non-discharge configuration thereof to the release or discharge configuration thereof. An elastic band 59 that passes around the cylinder 11 and over the arm 45 biases the latch 36 to the latching configuration thereof. The pressure of the band 59 can be overcome by a user pulling on the pull string 53.

Although a specific release mechanism has been shown in the drawings, other types of release mechanisms may be used in accordance with the invention. For example, a flange that does not swing or pivot could be used to secure the stopper in place. In such a device the flange may be secured to the inside of an upper part of the tube and either a lower part of the tube or the air cylinder could be rotated axially relative to the upper part (by use of threaded connection or the like) to move the flange from a latching configuration to a release configuration relative to the stopper.

It is to be understood that while certain forms of the present invention have been illustrated and described herein, it is not to be limited to the specific forms or arrangement of parts described and shown.

What is claimed and desired to be secured by letters patent is as follows:

1. A device for discharging confetti comprising:

a) an elongate tube having an interior chamber and a discharge end;

b) a compressed air cylinder having a mouth communicating with said chamber;

c) a stopper blocking flow of air through said mouth when in a non discharge configuration thereof;

d) confetti located in said chamber between said discharge end and said compressed air cylinder;

e) a release mechanism operably securing said stopper in the non discharge configuration thereof and allowing a user to release the stopper to a discharge configuration thereof wherein air from said compressed air cylinder flows into said chamber and blows said confetti so as to discharge said confetti from said tube discharge end;

f) said release mechanism including a keeper pivotly mounted at one end relative to said compressed air cylinder and having a non-released configuration wherein said keeper covers said stopper and holds said stopper in said cylinder mouth; and g) said release mechanism including a flange that engages said keeper opposite whereat said keeper is pivotly mounted; said flange maintaining said keeper in the non discharge configuration thereof until release is desired by a user; said flange being manually moveable by a user to disengage from said keeper so as to release said keeper and said stopper.

2. The device according to claim 1 wherein:

a) said flange is on an arm pivotly connected to said cylinder and includes a biasing band to urge said flange to the non discharge configuration.

3. The device according to claim 2 wherein:

a) said tube includes an intermediate aperture; and b) a pull string is joined to said arm and extends through said aperture operably allowing a user to pull on said string and urge said flange to the discharge configuration.

4. A device for discharging confetti comprising:

a) an elongate tube having an interior chamber; said tube having a discharge end and an opposite end;

b) a compressed air cylinder having a mouth communicating with said chamber; said cylinder being mounted in said tube opposite end;

c) a stopper blocking flow of air through said mouth when in a non discharge configuration thereof;

d) confetti located in said chamber between said discharge end and said compressed air cylinder; and e) a release mechanism operably securing said stopper in the non discharge configuration thereof and allowing a user to release the stopper to a discharge configuration thereof such that air from said compressed air cylinder flows into said chamber and propels said confetti from said tube discharge end; said release mechanism including a keeper pivotally connected at a pivot end to said device and having a surface covering at least part of said stopper in a non-release configuration; said keeper having an engagement end opposite said pivot end; said release mechanism also including a latch with an arm that is pivotally mounted on said device; said arm including a flange at one end that engages and holds said keeper engagement end when in the non-discharge configuration; said arm being biased to said non-discharge configuration; said release mechanism including a pull string attached to said arm and extending outside said tube to operably allow a user to move said latch to the discharge configuration by pulling on said pull string so as to release the compressed air and discharge the confetti.

* * * * *